US008043199B1

(12) United States Patent
Barker

(10) Patent No.: US 8,043,199 B1
(45) Date of Patent: Oct. 25, 2011

(54) EXERCISE MACHINE

(76) Inventor: Jerry Barker, Price, UT (US)

( * ) Notice: Subject to any disclaimer, the term of this patent is extended or adjusted under 35 U.S.C. 154(b) by 0 days.

(21) Appl. No.: 12/774,793

(22) Filed: May 6, 2010

(51) Int. Cl.
*A63B 26/00* (2006.01)
*A63B 21/068* (2006.01)
*A63B 21/00* (2006.01)

(52) U.S. Cl. ..... 482/140; 482/95; 482/132; 482/142

(58) Field of Classification Search ..... 482/95, 482/96, 131, 132, 147, 70, 71, 40, 142; D21/688, D21/689
See application file for complete search history.

(56) References Cited

U.S. PATENT DOCUMENTS

| | | | | |
|---|---|---|---|---|
| 3,756,595 | A | 9/1973 | Hague | |
| 4,391,441 | A | 7/1983 | Simjian | |
| 4,989,860 | A * | 2/1991 | Iams et al. | 482/132 |
| 5,232,423 | A | 8/1993 | Hajduczek | |
| 5,316,530 | A * | 5/1994 | Romer | 482/71 |
| 5,391,131 | A | 2/1995 | Gordon | |
| 5,549,529 | A * | 8/1996 | Rasmussen | 482/96 |
| 5,575,740 | A | 11/1996 | Piaget | |
| 5,584,785 | A * | 12/1996 | Wu | 482/95 |
| 5,676,626 | A * | 10/1997 | Huang | 482/96 |
| 6,196,954 | B1 * | 3/2001 | Chen | 482/131 |
| 6,196,956 | B1 * | 3/2001 | Brown | 482/137 |
| 6,231,484 | B1 | 5/2001 | Gordon | |
| 6,482,134 | B1 * | 11/2002 | Rasmussen | 482/96 |
| 7,179,212 | B2 | 2/2007 | Hsiung | |
| 7,226,401 | B2 * | 6/2007 | Van Stratten et al. | 482/112 |
| D565,134 | S * | 3/2008 | Brown et al. | D21/694 |
| 7,455,633 | B2 * | 11/2008 | Brown et al. | 482/142 |
| 7,559,882 | B2 * | 7/2009 | Chou | 482/148 |
| 7,611,445 | B2 | 11/2009 | Brown | |
| 7,662,076 | B1 * | 2/2010 | Ho | 482/130 |
| 7,780,585 | B1 * | 8/2010 | Rivas | 482/140 |
| D631,519 | S * | 1/2011 | Chen | D21/689 |
| 7,878,957 | B1 * | 2/2011 | Chen | 482/140 |
| 2006/0019800 | A1 * | 1/2006 | Berger et al. | 482/46 |
| 2007/0298943 | A1 | 12/2007 | Menta | |
| 2008/0200317 | A1 * | 8/2008 | Campanaro et al. | 482/140 |
| 2008/0207415 | A1 * | 8/2008 | Tsai | 482/147 |
| 2010/0022367 | A1 * | 1/2010 | McBride et al. | 482/140 |
| 2010/0062913 | A1 * | 3/2010 | Splane | 482/96 |

* cited by examiner

*Primary Examiner* — Allana Lewin
(74) *Attorney, Agent, or Firm* — Neustel Law Offices

(57) ABSTRACT

An exercise machine for providing a low impact workout that targets the core muscles. The exercise machine generally includes a lower frame adapted to rest upon a floor surface, an upper frame movably connected to the lower frame and movable between an upright in-use position and a folded compact position, an arced track supported in an inclined orientation by the upper frame, a pair of sway bars each pivotally connected adjacent an upper end of the upper frame, wherein the pair of sway bars are adapted for swinging movement along a length of the track and wherein the pair of sway bars move in unison, and a pair of knee retainers each movably connected to a respective sway bar, wherein the pair of knee retainers slidably and rotatably move independently of each other. Other components, such as handlebars, foot bars, seats, and elbow retainers are also utilized.

10 Claims, 8 Drawing Sheets

EXERCISE MACHINE

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a device for exercising and more specifically it relates to an exercise machine for efficiently providing a low impact workout that targets the core of the exerciser.

2. Description of the Related Art

Any discussion of the related art throughout the specification should in no way be considered as an admission that such related art is widely known or forms part of common general knowledge in the field.

Different types of exercise machines have been in use for years and are generally adapted to target one more muscle groups of the body. One particular area that is often focused upon by exercisers is the core area of the body by performing a cardiovascular workout. Such machines that provide cardiovascular workouts for the core area of the body often involve high impact which can be difficult and/or painful for many individuals. Other difficulties in prior art exercise devices include lack of muscle movement as well as various other shortcomings. Because of the inherent problems with the related art, there is a need for a new and improved exercise machine for efficiently providing a low impact workout that targets the core of the exerciser.

BRIEF SUMMARY OF THE INVENTION

A system for efficiently providing a low impact workout that targets the core of the exerciser. The invention generally relates to a device for exercising which includes a lower frame adapted to rest upon a floor surface, an upper frame movably connected to the lower frame and movable between an upright in-use position and a folded compact position, an arced track supported in an inclined orientation by the upper frame, a pair of sway bars each pivotally connected adjacent an upper end of the upper frame, wherein the pair of sway bars are adapted for swinging movement along a length of the track and wherein the pair of sway bars move in unison, and a pair of knee retainers each movably connected to a respective sway bar, wherein the pair of knee retainers slidably and rotatably move independently of each other. Other components, such as handlebars, foot bars, seats, and elbow retainers are also utilized.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
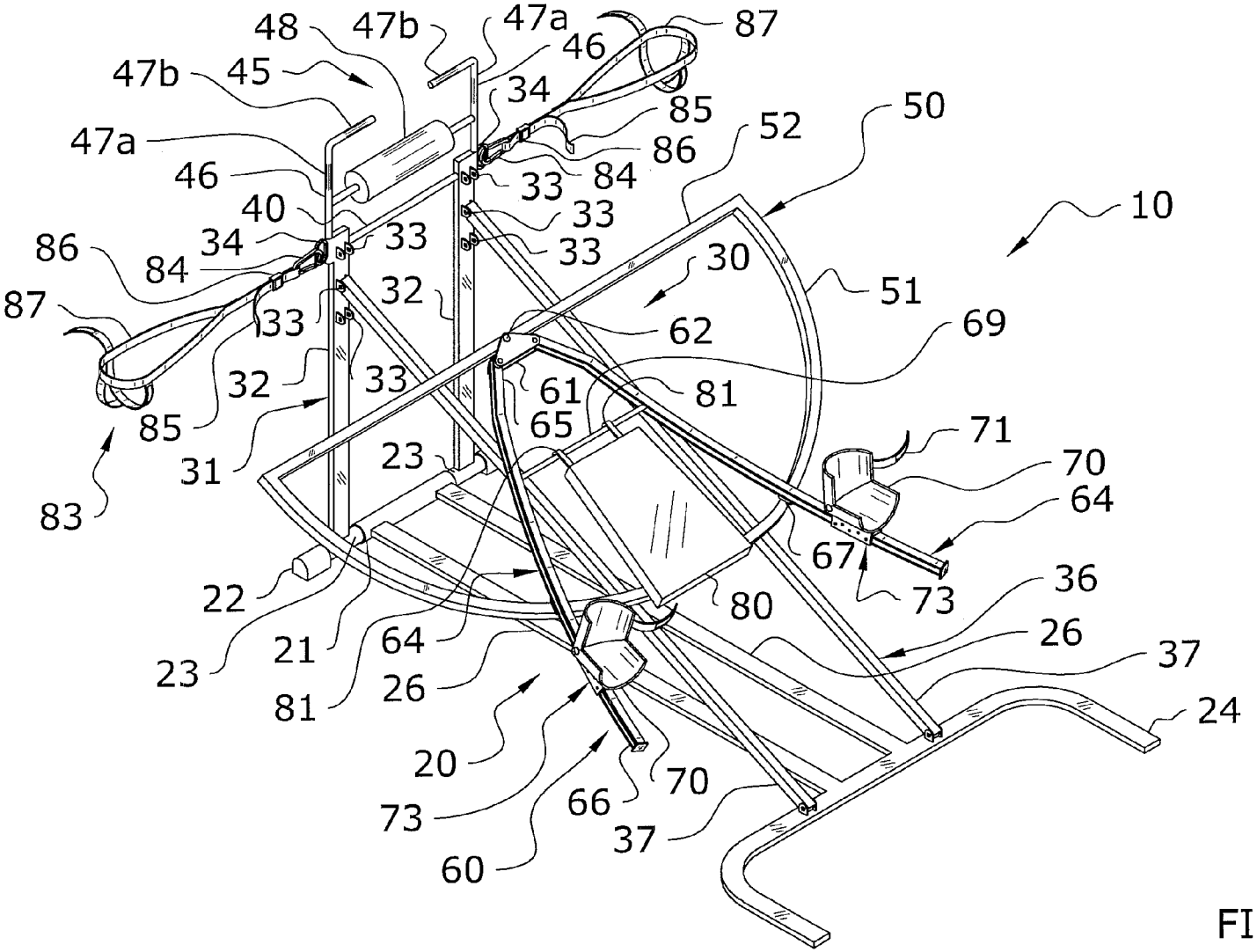
FIG. 1 is an upper perspective view of the present invention.
Figure 2:
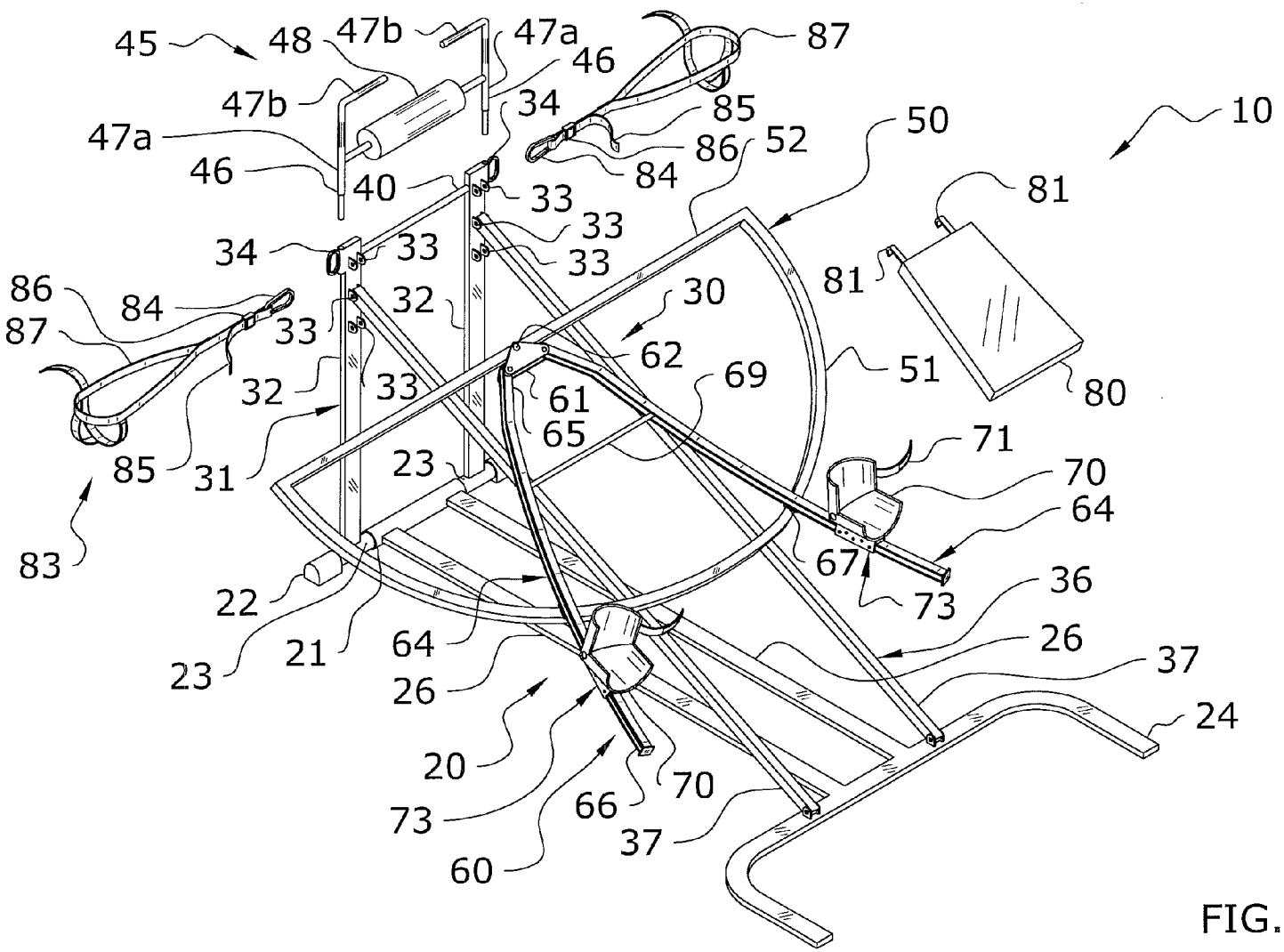
FIG. 2 is an exploded upper perspective view of the present invention.
Figure 3:
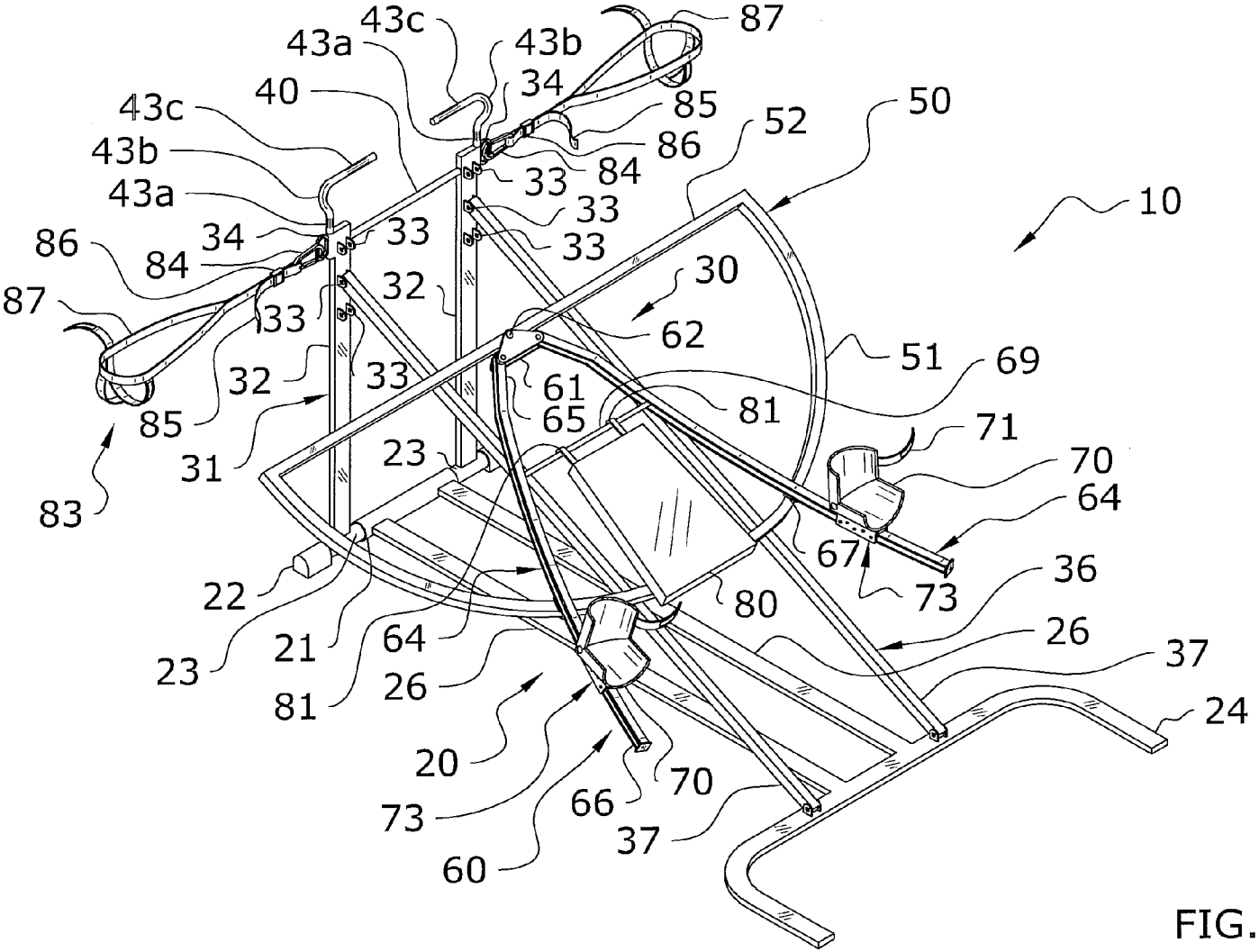
FIG. 3 is an upper perspective view illustrating handles in place of the footbar.
Figure 4:
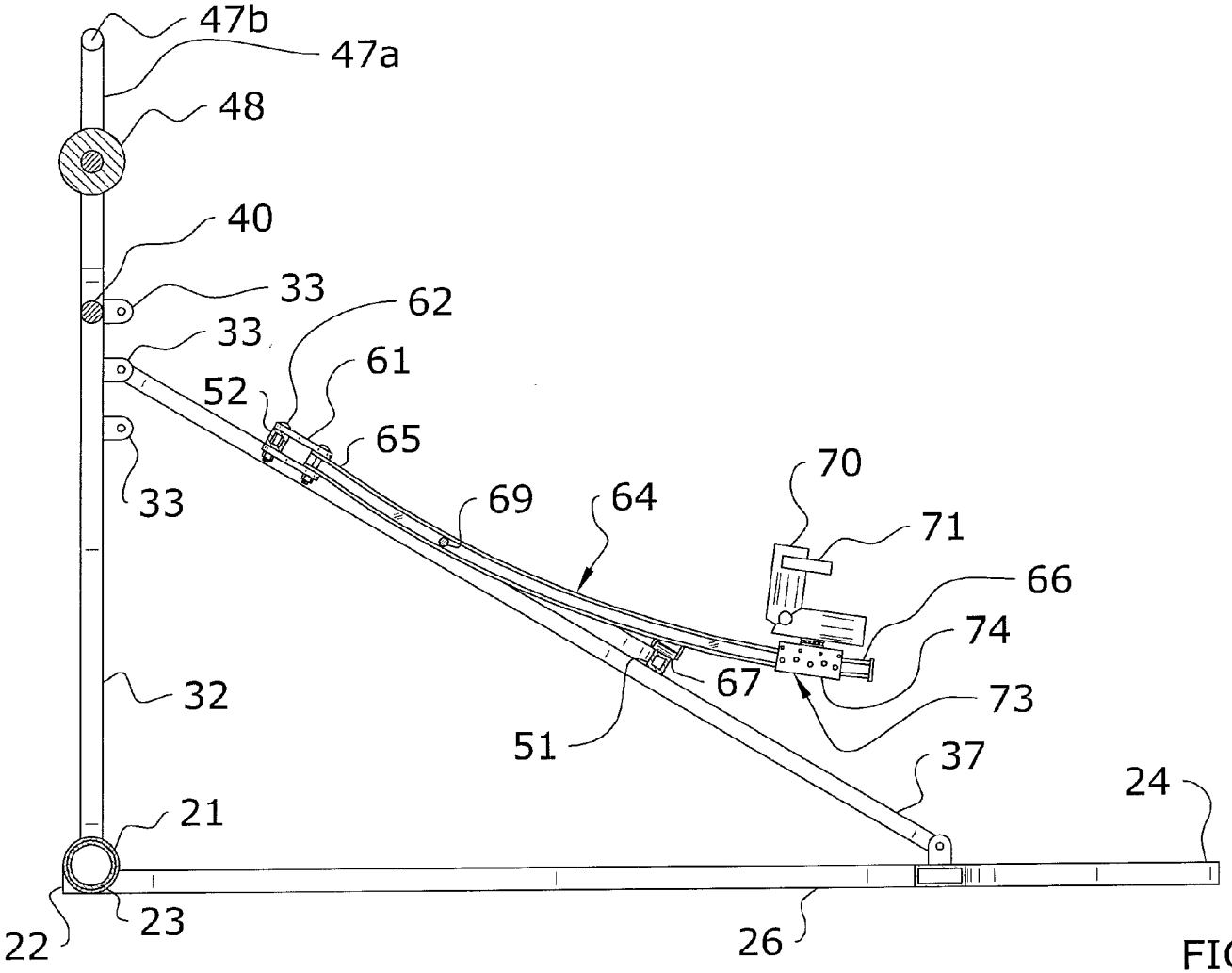
FIG. 4 is a side sectional view of the present invention.
Figure 5:
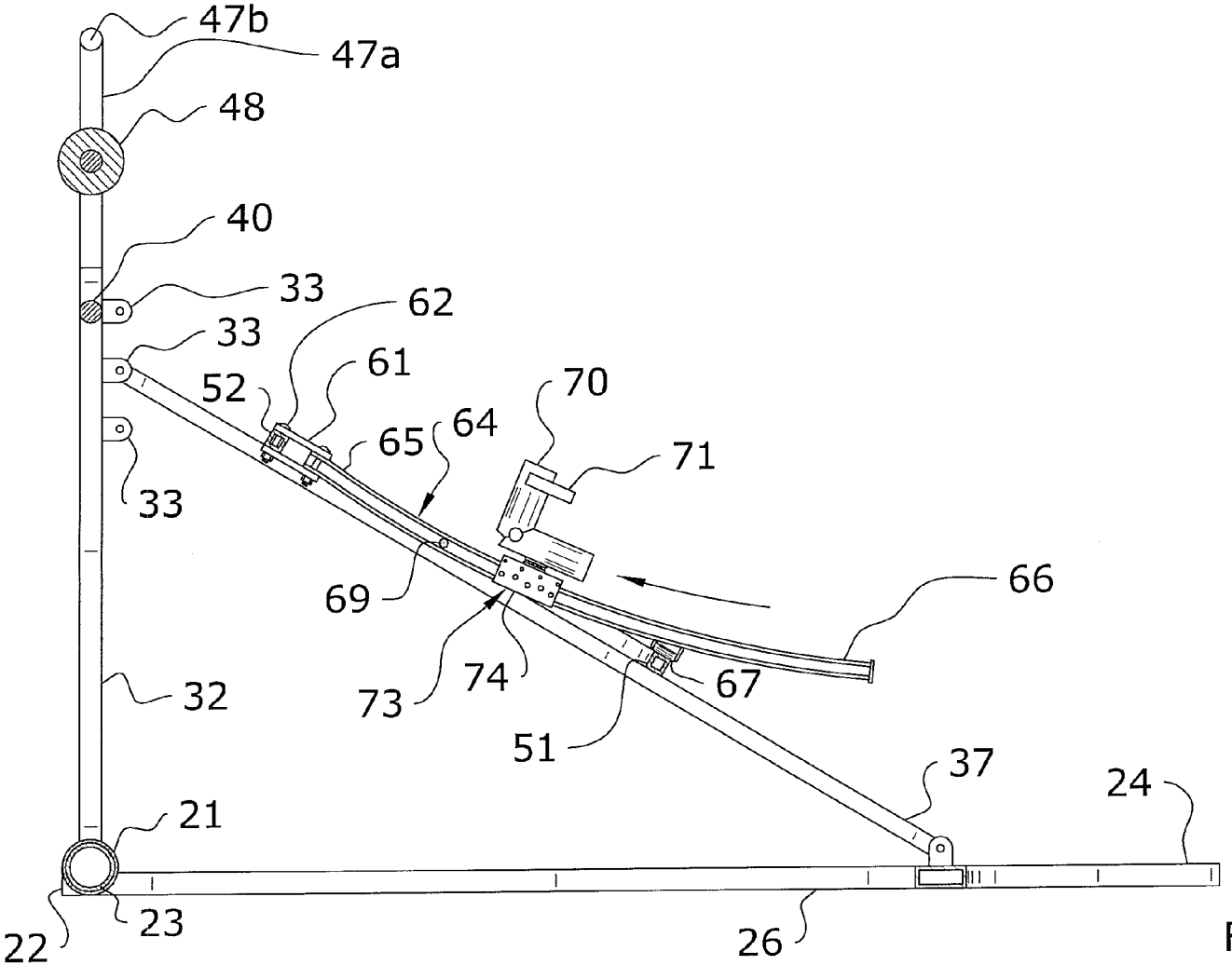
FIG. 5 is a side sectional view of the present invention illustrating the forward movement of the knee retainers.
Figure 6:
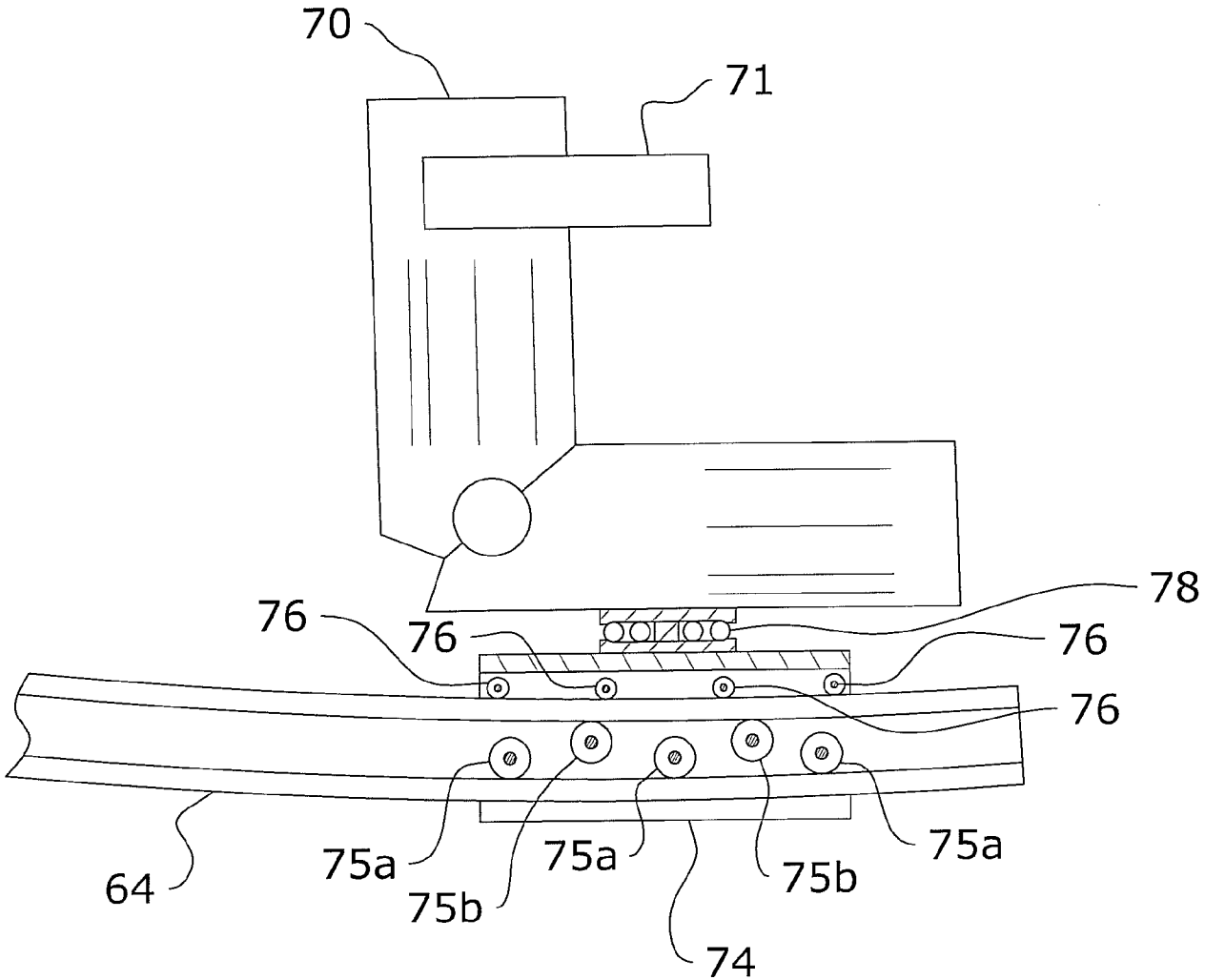
FIG. 6 is a side sectional view of the present invention illustrating the knee retainer and support assembly connected to the sway bar.
Figure 7:
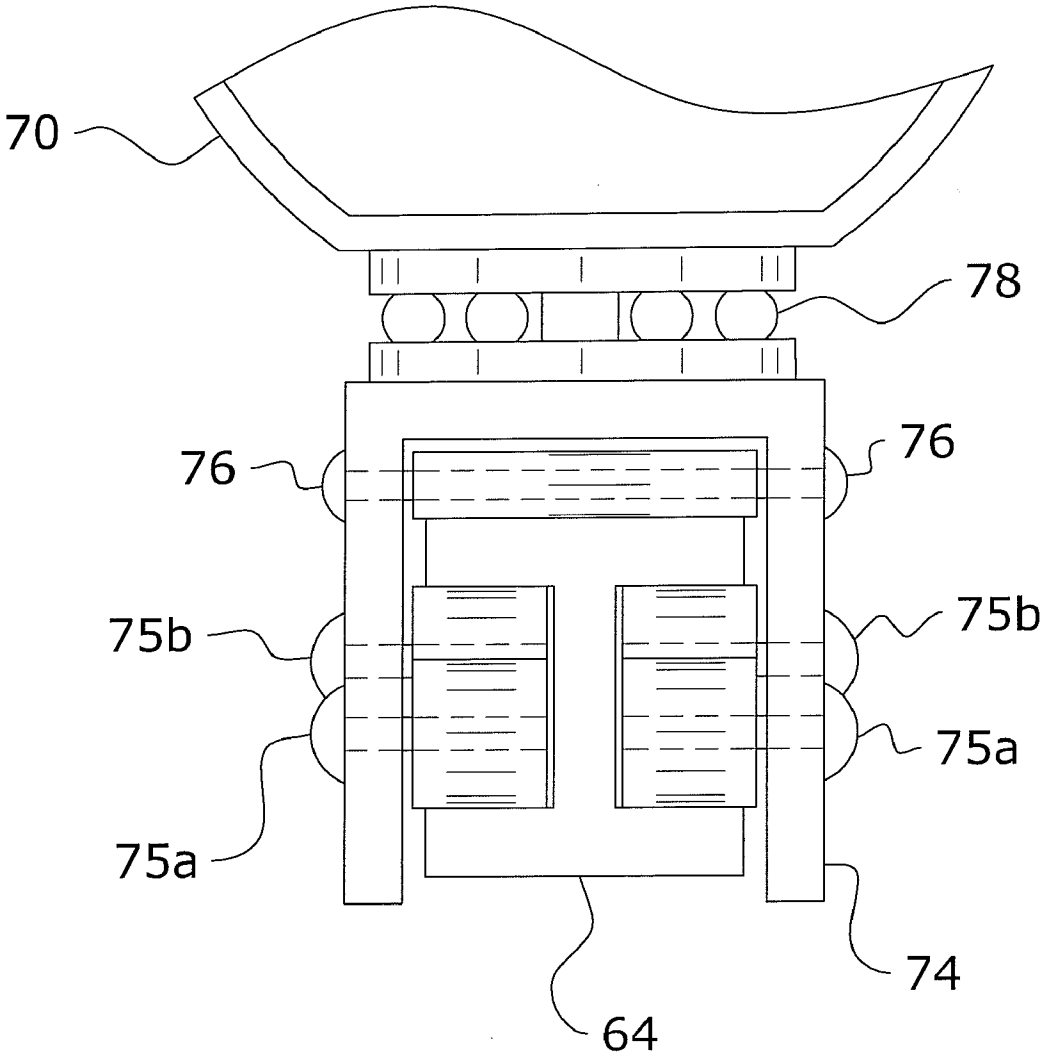
FIG. 7 is a rear view of the present invention illustrating the knee retainer and support assembly connected to the sway bar.
Figure 8:
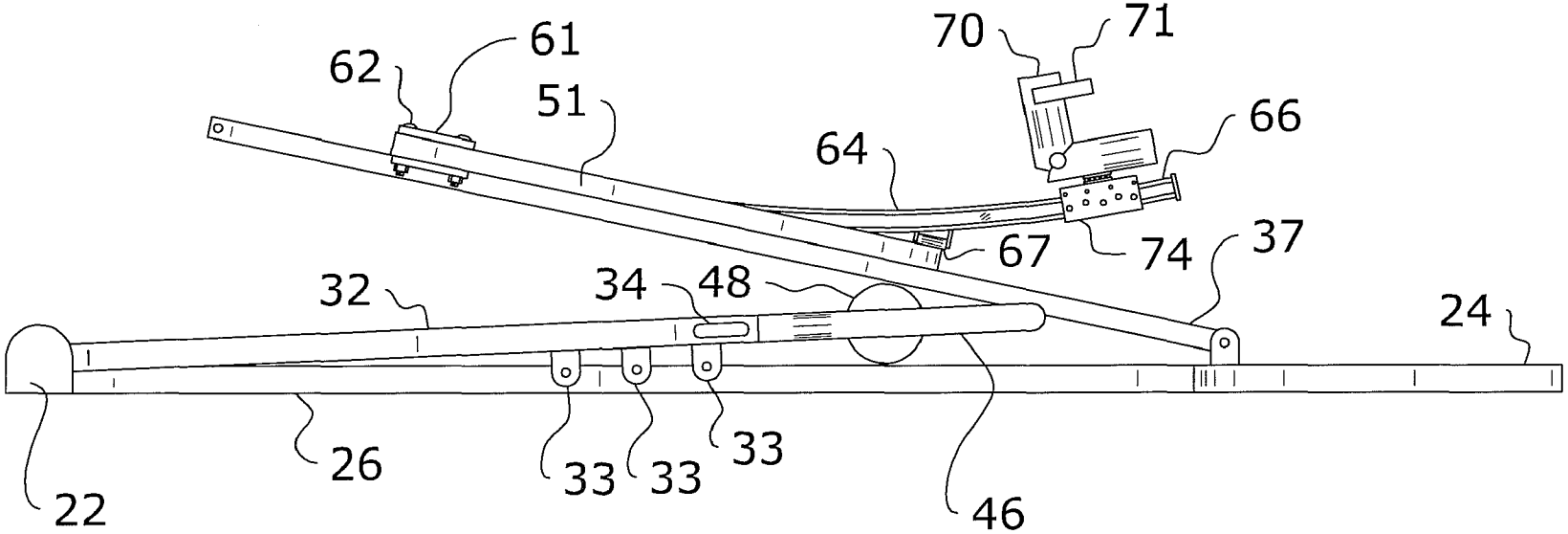
FIG. 8 is a side view of the present invention folded to a compact position.

Turning now descriptively to the drawings, in which similar reference characters denote similar elements throughout the several views, FIGS. 1 through 8 illustrate a exercise machine 10, which comprises a lower frame 20 adapted to rest upon a floor surface, an upper frame 30 movably connected to the lower frame 20 and movable between an upright in-use position and a folded compact position, an arced track 51 supported in an inclined orientation by the upper frame 30, a pair of sway bars 64 each pivotally connected adjacent an upper end of the upper frame 30, wherein the pair of sway bars 64 are adapted for swinging movement along a length of the track 51 and wherein the pair of sway bars 64 move in unison, and a pair of knee retainers 70 each movably connected to a respective sway bar 64, wherein the pair of knee retainers 70 slidably and rotatably move independently of each other. Other components, such as handlebars 40, 42, foot bars 45, seats 80, and elbow retainers 83 are also utilized.

B. Lower Frame

The lower frame 20 is generally adapted to rest upon a flat floor surface in a manner to stabilize the present invention during use. The lower frame 20 may simply rest upon the floor surface or the lower frame 20 may be attached to the floor surface in a secure and fixed manner, such as through the use of bolts, etc. The lower frame 20 is generally comprised of a substantially rigid and strong structure to withstand excessive movement thereon while the operator is exercising using the present invention.

Preferred components of the lower frame 20 generally include a first support 21 along a first end of the lower frame 20 and a second support 24 along a second end of the lower frame 20. Both the first support 21 and the second support 24 are adapted to stabilize the present invention and substantially grip or distribute weight upon the floor surface. Thus, both the first support 21 and the second support 24 are generally substantially wide to provide optimal stabilization.

The first support 21 generally includes gripping knobs 22 along each end both for providing traction upon the floor surface and for rotating a respective rotatable portion 23 inwardly positioned therefrom. The first support 21 is further preferably comprised of an elongated structure having a circular cross-section. The rotatable portions 23 are for allowing the vertical segment 31 of the upper frame 30 to fold downwards to a compact position for storage or transport of the present invention.

The second support 24 is generally U-shaped to cover a wide surface area of the floor for stabilization of the present invention. Connecting the first support 21 to the second support 24 are a pair of parallel horizontal supports 26 having an elongated structure and generally rectangular in cross-section.

C. Upper Frame

The upper frame 30 is supported in an upright position via the lower frame 20. The upper frame 30 is also generally comprised of a substantially rigid and strong structure to withstand excessive movement thereon while the operator is exercising using the present invention. Preferred components of the upper frame 30 generally include a vertical segment 31 extending vertically upward from rotatable portion 23 of the first support 21 and an inclined segment 36 extending from the second support 24 to the upper end of the vertical segment 31 thus forming an inclined orientation.

The vertical segment 31 generally includes a pair of parallel supports 32, each extending upwards from a respective rotatable portion 23. The supports 32 are able to be folded either to an upright position (during use) or parallel and next to the lower frame 20 (during storage) via the rotatable portions 23 of the first support 21. The vertical supports 32 also each include a plurality of vertically spaced adjustments 33 for receiving the upper end of the inclined segment 36 at differing heights to adjust the angle of the inclined segment 36 thus providing different resistances to the operator while exercising with the present invention. The adjustments 33 may be comprised of various structures, such as but not limited to openings to receive pins, etc.

Each of the vertical supports 32 also preferably include retainer rings 34 adjacent an upper end for connecting the elbow retainers 83 thereto. The vertical supports 32 are further hollow at least at an upper end to receive the handles 42 and/or foot bar 45 as will be described in the subsequent section.

The inclined segment 36 is pivotally connected at a lower end to the second support 24 or respective end of the horizontal supports 26 and is removably connected to the adjustments 33 of the upper end of the vertical supports 32 of the vertical segment 31. The vertical segment 31 preferably includes a pair of parallel inclined supports 37 each aligned with a respective vertical support 32 of the vertical segment 31 and a horizontal support 26 of the lower frame 20 to define triangle structures. During a compact position of the present invention, the upper end of the inclined segment 36 is removed from the vertical segment 31 and the vertical segment 31 is folded towards and parallel with the lower frame 20.

D. Handle and Foot/Leg Support Means

The present invention may include various handle means or foot/leg support means, generally located at an upper end of the vertical segment 31. The handle means or foot/leg support means may be removable from the upper frame 30 and/or vertical segment 31 or may be fixedly attached thereto. The handle means are generally utilized in connection with the knee retainers 70 and the foot/leg support means are generally used in connection with the seat 80 for hyperextensions, sit-ups, etc. It is appreciated that the handle means and/or foot/leg support means may be used in various other forms and with various other combinations of components of the present invention to achieve the desired exercise.

The handle means may take the form of several embodiments. In one embodiment, a handlebar 40 extends across between and connecting the vertical supports 32 of the vertical segments 31 at the upper end. The handlebar 40 may have various knurling or other gripping means thereon. In another embodiment of the handle means, a pair of handles 42 may each be removably received within the hollow upper end of the vertical supports 32 of the vertical segments 31. Each of the handles 42 generally include a vertical portion 43*a* for extending within the vertical supports 32, a curved portion 43*b* extending outwardly from the upper end of the vertical portion 43*a*, and a horizontal portion 43*c* extending back inwardly from the curved portion 43*b* for being grasped by the operator. The handles 42 are preferably each comprised of an integral one-piece structure. Other embodiments of the handle means may be appreciated.

The foot/leg support means may also take the form of several embodiments. In one embodiment, a foot bar 45 has a pair of spaced apart side supports 46 each having a vertical portion 47*a* for being removably received by the hollow upper end of the vertical supports 32 of the vertical segment 31 and a horizontal portion 47*b* extending inwardly from the upper end of the vertical portion 47*a* for being grasped by the operator or alternately to retain the legs of the operator against the padded support 48. The padded support 48 extends between the side supports 46 to connect the side supports 46 and is positioned beneath the horizontal portions 47*b* of the side supports 46. The padded support 48 may receive or retain the leg and/or the foot of the operator depending upon the exercise being performed.

E. Track Assembly

The track assembly 50 is supported in an inclined orientation via being connected in a fixed manner to the inclined supports 37 of the inclined segment 36. The track assembly 50 is generally centrally positioned upon the inclined supports 37; however other positions may be appreciated. The track assembly 50 is generally fixed to the inclined segment 36 of the upper frame 30; however the track assembly 50 may be removable.

The track assembly 50 generally includes an arced track 51 forming a semi-circular shape at a lower portion of the track assembly 50 and curving upwardly while being supported in a parallel manner with the inclined supports 37. The arced track 51 extends laterally outwardly a substantial distance from the inclined supports 37 to provide a wide-range of movement of the sway bars 64 for the operator to achieve optimal results while exercising using the present invention.

The track assembly 50 also generally includes an upper support 52 generally horizontally oriented and connecting upper and outer ends of the arced track 51 to stabilize the arced track 51. The upper support 52 is also generally fixed to the arced track 51 and inclined segment 36 as appreciated. The upper support 52 is further generally comprised of an elongated and straight structure.

F. Sway Means

The sway means is adapted to swing back and forth thus moving along the arced track 51 of the track assembly 50. The sway assembly 60 generally includes a connector 61 at an upper end to pivotally connect to the upper support 52 of the track assembly 50 at a location substantially centered upon the longitudinal length of the upper support 52 and at a radial center of the arced track 51. The connector 61 is generally triangular shaped having a pivot point 62 at an apex near the upper support 52 and having sway bars 64 extending from each respective lower apex and securely attached to the connector 61 to swing or pivot with the connector 61 and in unison.

The sway bars 64 each extend from the connector 61 in a spaced-apart manner, wherein the sway bars 64 are spaced apart a distance so the user may comfortably rest their knees in the knee retainer 70 attached to each sway bar 64 and spread their legs a comfortable distance apart. The sway bars 64 are generally curved along a substantial entire length of the sway bars 64 and more specifically curve upwardly thus inducing movement of the knee retainers 70 back and forth between an upper end and a lower end of the sway bars 64.

Each of the sway bars 64 also generally include a short first portion 65 extending from the connector 61 at an outward angle and then an elongated second portion 66 extending from the first portion 65 in a linear manner towards a parallel orientation at the lower end. Each of the sway bars 64 also generally employ an I-shaped cross-section, such as with an I-beam structure thus maintaining optimal strength and rigidity.

Between the upper end and the lower end of the sway bars 64, and preferably closer to the lower end, are rollers 67 fixed to the underside of each of the sway bars 64 that engage the upper surface of the arced track 51 and allow the sway bars 64 to freely move along the length of the arced track 51 when a swinging movement is applied to the sway bars 64. Various other types of mechanisms may be employed between the sway bars 64 and the arced track 51 to induce free movement.

A crossbar 69 also extends between and connects to the sway bars 64 near the upper end and first portion 65. The cross bar serves to add stability to the sway bars 64 and also to removably receive a seat 80 for performing the hyperextensions, sit-ups, etc. The seat 80 is generally comprised of a padded structure and, when attached, is oriented at an incline parallel with the orientation of the inclined segment 36. The front end of the seat 80 generally has a plurality of retainer hooks 81 extending therefrom for receiving the crossbar 69 and the rear end of the seat 80 is supported in various manners, such as by the sway bars 64, arced track 51, inclined segment 36 etc. The lower end of the seat 80 may also include various mechanisms for inducing free movement along the track 51 with the sway bars 64.

G. Knee Retainers

The present invention includes the knee retainers 70 to receive and support the knees of the operator in a secure and comfortable manner, wherein each sway bar 64 has a knee retainer 70 movably connected thereto. The knee retainers 70 may have various amounts of padding therein and straps 71 to secure the knee within the knee retainer 70 as appreciated.

Each knee retainer 70 includes a support assembly 73 for movably connecting the knee retainer 70 to a respective sway bar 64. The support assembly 73 generally includes an inverted U-shaped support 74 for being positioned over the respective sway bar 64. A plurality of first lower rollers 75*a* and second lower rollers 75*b* extend inwardly within each side passageway defined by the I-beam structure of the sway bars 64. The rollers 75*a*, 75*b* are generally vertically offset so that the first lower rollers 75*a* travel along the upper surface of the lower plate of the I-beam structure and the second lower rollers 75*b* travel along the lower surface of the upper plate of the I-beam structure.

The U-shaped support 74 also generally includes a plurality of spaced upper rollers 76 between the top plate of the support and the upper plate of the I-beam structure. The plurality of rollers 75*a*, 75*b*, 76 ensures that the support assembly 73 travels smoothly and in a stable manner along the length of the sway bars 64. The rollers 75*a*, 75*b*, 76 allow the support assembly 73 and connected knee retainer 70 to freely move up and down the sway bars 64. The support assembly 73 also generally includes a swivel 78 attached at an upper end for rotatably connecting the knee retainer 70 to the support assembly 73.

H. Elbow Retainers

The elbow retainers 83 are preferably utilized to receive the elbows of the operator when utilizing the present invention in the swaying motion, thus forcing the user to isolate their core or abs while performing the back-and-forth swaying motion. The elbow retainers 83 are connected to the retainer rings 34 of the vertical segment 31 and are allowed to freely swing therefrom.

The elbow retainers 83 generally each include a clasp 84 for being removably secured to the retainer ring 34, a strap 85 extending from the clasp 84, and an elbow harness 87 extending from the strap 85 for receiving the elbow of the operator while the elbow is in a bent position. The strap 85 may also include an adjustment member 86 for adjusting the length of the strap 85 and thus distance of the harness 87 away from a respective vertical support 32 of the vertical segment 31.

I. Operation of Preferred Embodiment

In use, the present invention may be utilized to perform various exercises. For a first exercise utilized for core isolation and cardiovascular workout, operator sits in a kneeling position with the knees of the operator positioned within the knee retainer 70 and the elbows of the operator positioned within the elbow retainers 83 and the handles 42 or handlebar 40 grasped accordingly. The operator then applies a swaying motion to the sway bars 64 thus moving the sway bars 64 back and forth along the arced track 51 to work the core of the user and improve cardiovascular fitness. The incline of the inclined segment 36 may be adjusted as appreciated. Alternately, the operator may attach the seat 80 to the sway bars 64 and sit upon the seat 80 with their feet resting upon the foot bar 45 while performing the swaying exercise. The operator may also perform various other exercises as appreciated, such as but not limited to hyperextensions, sit-ups, etc. Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An exercise machine, comprising:

a lower frame adapted to rest upon a floor surface;

an upper frame supported by said lower frame;

wherein said upper frame has a vertical segment extending from a first end of said lower frame and an inclined segment extending from a second end of said lower frame and connecting with said vertical segment;

a handle means connected adjacent an upper end of said vertical segment;

an arced track supported in an inclined orientation by said inclined segment;

a pair of sway bars each having an upper end that is pivotally connected adjacent an upper end of said inclined segment, wherein said pair of sway bars are adapted for swinging movement along a length of said track and wherein said pair of sway bars move in unison; and a pair of knee retainers each movably connected to a respective sway bar of said pair of sway bars, wherein said pair of knee retainers move independently of each other.

2. The exercise machine of claim 1, wherein said pair of knee retainers are slidably connected to said pair of sway bars.

3. The exercise machine of claim 1, wherein said pair of knee retainers are rotatably connected to said pair of sway bars.

4. The exercise machine of claim 1, including a pair of elbow retainers connected to said upper frame near a forward end.

5. The exercise machine of claim 4, wherein said pair of elbow retainers each include an elbow harness.

6. The exercise machine of claim 1, wherein said upper frame is movably connected to said lower so that said upper frame may be adjusted to an upright in-use position and a folded compact position.

7. The exercise machine of claim 1, wherein said pair of sway bars includes rollers extending from an underside from thereof for engagement with said arced track for free movement thereupon.

8. The exercise machine of claim 1, including a seat removably attached to said pair of sway bars.

9. The exercise machine of claim 1, including a foot bar removably attached to a forward end of said upper frame.

10. An exercise machine, comprising:

a lower frame adapted to rest upon a floor surface, wherein said lower frame includes a first support at a first end, a second support at a second end, and a pair of parallel horizontal supports connected between thereof;

wherein said first support is comprised of circular cross-section having a pair of rotatable portions and a gripping portions coupled to said pair of rotatable portions;

wherein said second support is comprised of a U-shaped structure;

an upper frame movably connected to said lower frame;

wherein said upper frame has a vertical segment having a pair of vertical supports extending from said pair of rotatable portions;

wherein said pair of vertical supports each include a plurality of adjustments and a retainer ring;

wherein said upper frame includes an inclined segment having a pair of inclined supports extending from said second support to an upper end of said pair of vertical supports;

wherein an upper end of said inclined supports is adjustable in height via said plurality of adjustments;

a handlebar extending between said pair of vertical supports;

a pair of handles extending from said pair of vertical supports, pair of handles have a curved structure;

a foot bar removably connected to said pair of vertical supports, wherein said foot bar includes a padded support;

wherein said upper frame is movably connected to said lower so that said upper frame may be adjusted to an upright in-use position and a folded compact position;

wherein said pair of horizontal supports, said pair of vertical supports, and said pair of inclined supports define a triangular structure;

a track assembly supported in an inclined orientation via said pair of inclined supports;

wherein said track assembly has an arced track curving upwardly and an upper support interconnecting upper/outer ends of said arced track;

a sway assembly having a connector and a pair of sway bars;

wherein said connector is pivotally connected to a midpoint of said upper support of said track assembly;

wherein said pair of sway bars angularly extend downwardly from said connector;

wherein said pair of sway bars are comprised of an I-shaped cross-section;

wherein said pair of sway bars curve upwardly;

wherein said pair of sway bars each include a first angled portion and a second angled portion, wherein said second angled portion angled inwardly from said first angled portion;

wherein said pair of sway bars each include rollers extending from an underside for engagement with said arced track and adapted to allow swinging movement of said pair of sway bars along a length of said track;

wherein said pair of sway bars move in unison;

wherein said sway assembly includes a crossbar interconnecting said pair of sway bars;

a pair of knee retainers supported along said pair of sway bars;

a pair of support assemblies for connecting said pair of knee retainers to said pair of sway bars;

wherein said pair of support assemblies each include a plurality of lower rollers for traveling within side passageways of said I-shaped sway bars;

wherein said pair of support assemblies each include a plurality of upper rollers for traveling atop said I-shaped sway bars;

wherein said plurality of lower rollers and said plurality of upper rollers are adapted to allow free sliding movement of said pair of knee retainers with respect to said pair of sway bars;

wherein said pair of support assemblies each include a swivel, wherein said swivel is adapted to allow free rotational movement of said pair of knee retainers with respect to said pair of support assemblies;

wherein said pair of knee retainers move independently of each other;

a seat having a plurality of retainer hooks, wherein said plurality of retainer hooks are adapted to hook upon said crossbar to support said seat in an inclined orientation; and a pair of elbow retainers each having a clasp adapted to removably connect to said retainer ring of said pair of vertical supports, an adjustable strap extending from said clasp, and an elbow harness extending from said adjustable strap.

* * * * *